United States Patent [19]

Shelton

[11] 4,144,968

[45] Mar. 20, 1979

[54] DISPOSABLE FOOD TRAY AND CONTAINER SYSTEM

[76] Inventor: Kenneth Shelton, 327 Candry Ter., Baltimore, Md. 21221

[21] Appl. No.: 919,138

[22] Filed: Jun. 26, 1978

[51] Int. Cl.[2] ..... B65D 21/02; B65D 51/16; B65D 85/62

[52] U.S. Cl. ..... 206/509; 220/23.83; 220/366; 220/367; 220/380

[58] Field of Search ..... 206/509, 508, 511, 512; 220/3.1, 23, 23.83, 366, 380, 367

[56] References Cited

U.S. PATENT DOCUMENTS

| | | | |
|---|---|---|---|
| 3,532,247 | 10/1970 | Bridges | 206/509 X |
| 3,642,165 | 2/1972 | von der Osten | 220/23.83 |
| 3,695,424 | 10/1972 | Cristy et al. | 220/23.83 X |
| 4,049,152 | 9/1977 | Treanor | 220/367 X |

*Primary Examiner*—William Price
*Assistant Examiner*—Steven M. Pollard
*Attorney, Agent, or Firm*—Morton J. Rosenberg

[57] ABSTRACT

A disposable food tray and container system formed of at least a pair of container elements generally having an overall circular contour. The container elements include a central substantially planar member joined in one-piece formation to a rim element extending around the periphery of the planar section. The rim element has upper and lower elements with discrete apertures formed therethrough. The upper and lower rim elements are matingly interfaceable in order to provide a box-like structure. Upper and lower apertures may be aligned in a varying manner by slidable rotation of one element on another subsequent to the nesting interfacing and locking construction. By providing varying sizes of through openings determined by the position of the upper and lower apertures, the venting of vapors contained within the system may be adjusted as to the rate of dispersal to the environment. The upper and lower elements or sections of the rim element includes bead or lug members on an upper surface and a recess formed within a lower surface. The bead or lug members of one rim element are insertable within the recess of a second rim element to provide the nesting interface when the system is used as a box-like container. When the container elements are utilized alone, they may be used as a tray for consuming edible material at the site of a commercial establishment. When used as a box-like structure, the system may be used to transport material contained therein to a remote site.

16 Claims, 6 Drawing Figures

20
26
18
28
12
2
2
14
34
36
10
22
26
36
28
28
16
12
36
34

38
34
34
12
30
28
26
18
10
34
36
24
14
32
36
30
26
28
18
24
36
32
40
12
38
34
34
30
26
18
28
24
16
32
36
36
22
40

FIG. 3
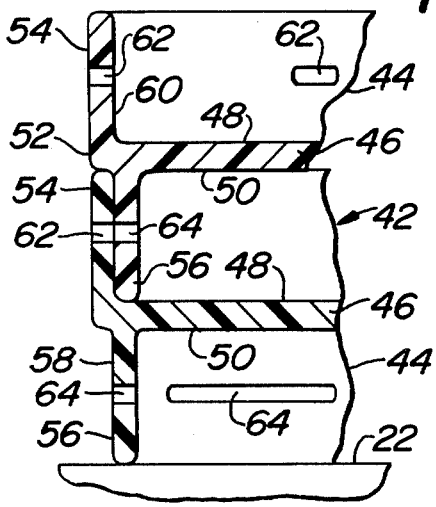
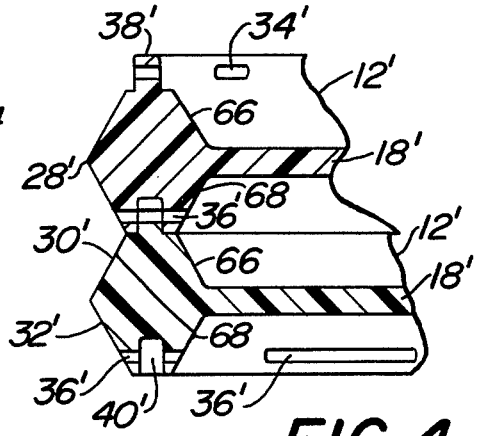
FIG. 4
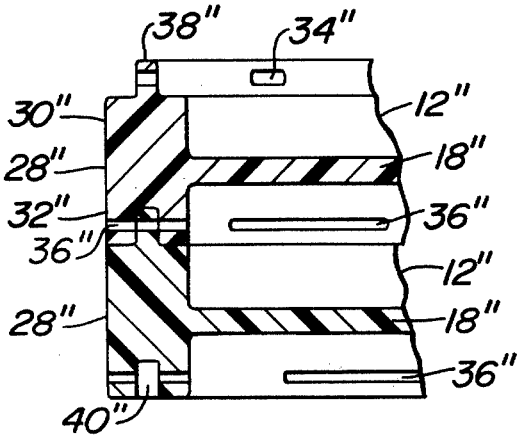
FIG. 5
FIG. 6
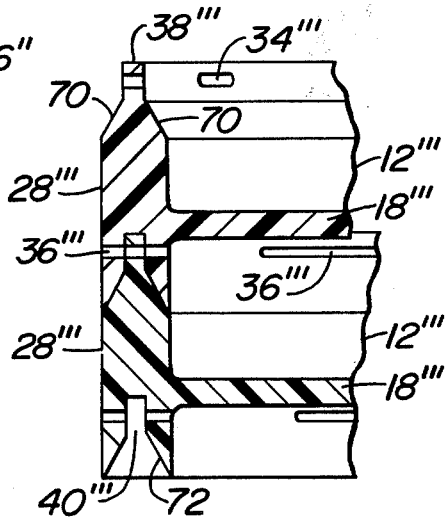

DISPOSABLE FOOD TRAY AND CONTAINER SYSTEM

BACKGROUND OF THE INVENTION

1. Field of the Invention

This invention pertains to food systems. In particular, this invention relates to a food system which may be either utilized as a food tray, or converted into a box-like structure for transport of the edible material to a remote location. Still further, this invention relates to a disposable food tray and container system combination. More in particular, this invention relates to a disposable food tray and container system which is generally symmetric in design. Still further, this invention relates to a disposable food tray and container system where internal vapors or gases may be dispersed to the external atmosphere at a controlled rate. Still further, this invention relates to a one-piece design disposable food tray and container system which may be easily stamped or molded. More in particular, this invention relates to a disposable food tray and container system which provides for particularly contoured elements to maximize heat insulation for maintaining food in a heated state over a period of time.

2. Prior Art

Food tray and container systems are known in the art. The closest prior art known to applicant are provided in U.S. Pat. Nos. 3,335,846; 4,058,214; 3,754,640; 3,484,015; 3,845,875; 3,828,967; 3,613,933; 3,708,086; and, 3,799,386. In some of the prior art, the food is contained within a box-like structure. However, in some such prior systems, the platter section containing the food is in contact with a base surface which optimizes heat removal. Additionally, such prior art provides for increased currents of stains and drippings through the platter section. This has the effect of increasing clean-up costs while at the same time, permitting transport of heat at an increased rate which is derogatory from the user's standpoint.

In other prior food systems, the box-like structure is not symmetrical in nature to provide a nesting, interfacing, and locking effect to provide the dual use of one container contour being utilized for both a platter, as well as a box structure for removal of the edible material to a remote location.

In other prior food systems, vent openings may be utilized, however, such do not allow for adjustment by rotation of one container element with respect to another. In such prior systems, the amount of vapor being passed to the external environment is not easily adjusted and thus, the length of the transport to the remote location may cause non-optimization of the heat removal from internal to the box-like structure.

SUMMARY OF THE INVENTION

A disposable food tray and container system which comprises at least a pair of container elements. Each of the container elements has a central substantially planar section and a rim element. Each of the rim elements extends around the planar section in a substantially closed contour manner. Additionally, each of the rim elements has a pair of upper and lower cooperating elements for nesting interface of one of the upper cooperating elements of one of the container elements with the lower cooperating element of a next successive one of the container elements. Each of the upper and lower cooperating elements has at least one aperture formed therethrough. The apertures are alignable for permitting exit of gaseous products when the upper and lower cooperating elements of the pair of container elements are in nesting interface relation.

An object of the instant invention is to provide a relatively inexpensive disposable tray for commercial establishments.

Another object of the subject invention is to provide a single element structure which may be mounted to a second structure of the same design to provide a box-like system for removal of edible material to a remote location.

A still further object of the subject invention is to provide a container system where gaseous or vapor products being emitted from internal to the box-like structure is vented to the external atmosphere in an adjustable manner.

A further object of the subject invention is to provide a disposable food tray and container which has the dual purpose of being utilized as a platter and as an enclosure for edible material while optimizing heat transfer characteristics.

A still further object of the subject invention is to provide a single container element which becomes a bottom section of a box-like structure, a top section of a box-like structure, and the platter portion for removing food therefrom in a consumable manner.

Another object of the subject invention is to provide a single contour element design which permits stackability within an establishment in an optimized space saving manner.

Still further, another object of the invention is to provide a single element design which permits a displaceable distance to exist between the platter section and a base surface upon which the container elements are mounted.

A still further object of the instant invention is to provide a disposable food tray and container which will increase labor savings in that once the edible material is consumed, the entire system including any edible material which is left may be disposed of without the necessity of washing, drying, or otherwise sanitizing the container system.

BRIEF DESCRIPTION OF THE DRAWINGS

FIG. 3 is a cross-sectional view of an embodiment of the disposable food tray and container system shown in FIG. 1;

FIG. 4 is a cross-sectional view of another embodiment of the disposable food tray and container system shown in FIG. 1 where the rim elements are formed in a truncated rhomboid type configuration;

FIG. 5 is a still further embodiment of the disposable food tray and container system shown in FIG. 1 where the rim elements and associated lug and recess members are formed in a rectangular configuration; and, FIG. 6 is a still further embodiment of the disposable food tray and container system shown in FIG. 1 where the rim elements include an external tapered surface for mating interface with an internal tapered surface of a recess.

DESCRIPTION OF THE PREFERRED EMDOBIMENTS

Figure 1:
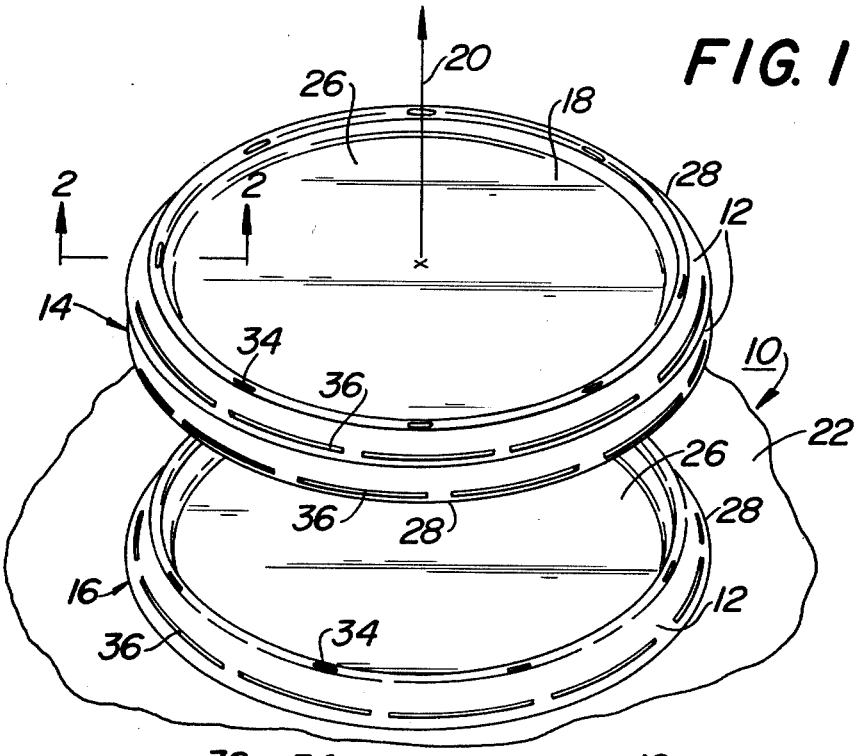
FIG. 1 is a perspective view of the disposable food tray and container system showing container elements mounted each to the other and a single container element utilizable as a platter.
Figure 2:
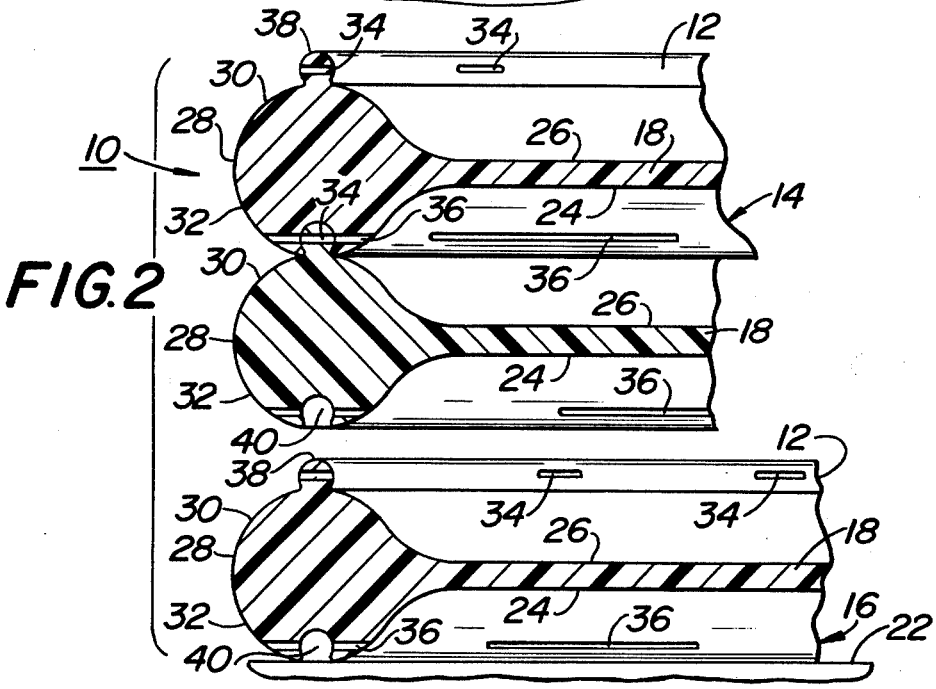
FIG. 2 is a sectional view of the disposable food tray and container system taken along the section line 2—2 of FIG. 1.

Referring now to FIGS. 1 and 2, there is shown food tray and container system 10. As can be seen in FIG. 1 and as will be described in following paragraphs, system 10 may be composed of two container elements 12 mounted in interfacing relation to form box-like structure 14 or one container element 12 may be utilized as a food tray 16. Food tray and container system 10 is adapted for use in commercial food establishments. When container element 12 is utilized by itself, food may be inserted and consumed therefrom within the commercial establishment. In the alternative, when a pair of container elements 12 are utilized in nesting interfacing relation, food inserted therein may be transported remote from the commercial establishment to the user's point of consumption. As will be further described, when used in box-like structure 14, the food contained therein is maintained in an optimally thermal manner while providing for vapor vents which prevent food vapors from condensing on the food contained within box-like structure 14. Through the unique contour and structure of system 10, proprietors of commercial establishments may optimally stack container elements 12 prior to use. Further, disposable qualities of system 10 provide for benefits to proprietors in providing labor saving devices such that elements 12 may be thrown away or otherwise disposed subsequent to use without the necessity of cleaning plates or without cleaning trays 16. It is to be understood, that disposable food tray and container system 10 as herein provided, may be adapted for commercial establishment use, however, such may be used in domestic operations.

Disposable food tray and container system 10 includes a pair of container elements 12 utilized in nesting and interfacing relation when a box-like structure 14 is to be provided. A singular container element 12 may serve to provide a tray 16 for consumability of food contained therein. Each of container elements 12 has central substantially planar section 18 which extends in a horizontal plane when taken with respect to a base surface upon which container element 12 is mounted during use. In overall concept, each container element 12 is generally symmetrical in contour about a vertical direction defined by vertically extending directional arrow 20 passing through a central point of container element 12 as is shown in FIG. 1.

Substantially planar section 18 may have a wide variety of thicknesses when taken with respect to vertical direction 20. Commercially successful thicknesses have ranged between one-sixteenth of an inch to one-half inch, however, such is generally not important to the inventive concept as is herein described. Of important consideration is that planar section 18 be displaced from base surface 22 in vertical direction 20. As is evident, food is maintained on upper surface 26 of planar section 18 whether system 10 is being used as a box-like structure 14 or as tray 16. However, the importance of maintaining lower surface 24 of planar section 18 out of contact with base surface 22 is decidedly relevant in that when lower surface 24 is vertically displaced from base surface 22, there is no contiguous interface of lower surface 24 with surface 22 and such minimizes stains or other leakage contamination to surface 22. Additionally, and of equal importance, it is seen that by merely maintaining planar section 18 in a displaced fashion or manner from base surface 22, there is an inherent thermal insulation factor associated with the food being maintained on upper surface 26. In this manner, food is not provided with a thermally conductive path to base surface 22 except at end points which will be discussed in following paragraphs. The ambient environment is a well-known thermal insulation type environment and the displacement of planar section 18 from base surface 22 provides for increased maintenance of food temperatures over a predetermined time interval than would be had if lower surface 24 were in contiguous interfacing contact with base surface 22.

Substantially planar section 18 of each container element 12 is joined in one-piece formation to a respective rim element 28 as is seen in FIGS. 1 and 2. Each of rim elements 28 extend substantially around planar section 18 in a closed contour manner. Rim elements 28 include upper and lower cooperating elements or sections 30 and 32 respectively. Upper and lower cooperating elements or sections 30 and 32 are contoured for nesting interface of one of upper cooperating elements 30 of one of container elements 12 with lower cooperating element 32 of a next successively mounted container element 12. Upper and lower cooperating sections 30 and 32 may be joined in one piece formation to substantially planar section 18 as is shown in FIG. 2 and further may be joined each to the other in one piece formation through molding or some like technique not important to the inventive concept as is herein described.

In the preferred embodiment shown in FIGS. 1 and 2, rim element 28 is formed in a spheroidal manner and includes an arcuate contour when taken with respect to a cross-sectional plane normal to a peripheral line extending in closed contour around container element 12. Additionally, container element 12 in the preferred embodiment is generally circular in contour when taken with respect to a horizontal plane or cross-sectional plane normal to vertical direction 12 as defined by vertical direction 20 to vertical direction 20. As will be seen, and which is of importance to the inventive concept, the circular contour of container element 12 allows rotational displaceability of one container element 12 with respect to a second container element in the horizontal plane. The rotationally displaceable type of movement is particularly adaptable to the circular contour as is shown in FIGS. 1 and 2.

Each of upper cooperating elements or sections 30 and lower cooperating elements or sections 32 include respective discrete apertures 34 and 36. Apertures 34 and 36 form a through passage in a radial direction through upper and lower cooperating elements or sections 30 and 32. Apertures 34 and 36 of two container elements 12 are alignable for permitting exit of vapor or gaseous products when upper and lower cooperating elements 30 and 32 of a pair of container elements 12 are in nesting interface. As can be seen, rotational capability of container elements 12 with respect each to the other when the nesting relationship is in effect, allows a larger or smaller through opening area to provide control of exiting vapors dependent upon the length of time necessary to remove system 10 to a remote location.

Thus, upper and lower apertures 34 and 36 are seen to be discrete in nature around the periphery of each container element 12. Apertures 34 and 36 extend throughout a predetermined segment of the circular contour as is shown in FIG. 1 for varying and adjusting the size of the through opening when apertures 34 and 36 are in an aligned relation. Thus, there is seen the importance of providing a nesting pair of container elements with rotatable slidable contact each with respect to the other wherein such allows the adjustment of the size of the through openings when upper and lower apertures 34 and 36 are aligned.

Each of upper cooperating elements or sections 30 includes lug member 38 which may be in the form of a bead member extending in closed contour around the periphery of container element 12. As is seen in the particular construction shown in FIGS. 1 and 2, bead member or lug 38 is provided with upper aperture 34 passing in a radial direction therethrough and having a predetermined segment dimension in the circular direction. Bead member 38 extends in a vertical direction above the main portion of cooperating element or section 30 as is clearly shown.

Lower cooperating element or section 32 includes recess 40 formed therein on a lower portion thereof for insert of an interfacing lug member 38 of a next successively mounted container element 12. As can be seen, recess 40 is intercepted by lower apertures 36. When two container elements 12 are mounted in nesting relation, apertures 34 and 38 may be aligned as is shown in FIG. 2. Lug or bead member 38 has a general overall contour similar in nature to the internal surface contour of recess 40. Where the materials of container element 12 are slightly yieldable, lug or bead member 38 may be deformably forced into recess 40 of a next succeeding container element 12 in order to provide the necessary interfacing and nesting fit for carrying such in box-like structure 14.

Referring now to FIG. 3, there is shown an embodiment of overall food tray and container system 10. In this embodiment, container system 42 includes container elements 44 which are mounted each to the other in nesting interfacing relation. Additionally, as was the case in the preferred embodiment, there is a central substantially planar section 46 for maintaining food on upper surface 48. As was the case in the preferred embodiment, lower surface 50 is maintained out of contact with base surface 22 for the same reasons as previously discussed. Rim element 52 extends substantially around the periphery of planar section 46. Rim element 52 is formed of upper cooperating element or section 54 and lower cooperating element or section 56. In this embodiment, it is seen that upper cooperating element 54 is displaced in a radial direction from lower cooperating element 56 and are joined each to the other and to planar section 46 in generally one piece formation. The displacement of upper cooperating section 54 from lower cooperating element or section 56 is generally substantially equal to the radial thickness of each of elements 54 and 56. Thus, upper cooperating element 54 may be mounted external and in interfacing relation with a corresponding lower element 56 of a next succeeding container element 44. Thus, it is seen that lower cooperating element outer surface 58 may slidingly interface with upper cooperating inner surface 60.

Upper cooperating element or section 54 includes a plurality of upper element apertures 62 and lower cooperating element or section 56 includes a plurality of discrete lower element apertures 64. Additionally, where a circular contour for container elements 44 is provided, apertures 62 and 64 may be interfaced in an adjusting manner by rotation in a horizontal plane of one of container elements 44 with respect to a next succeeding container element 44.

As was the case in the preferred embodiment, it is seen that lower surface 50 of substantially planar section 46 is vertically displaced from base surface 22. This particular construction of container elements 44 is provided for the same purposes and objectives as has hereinbefore been described in the preferred embodiment concept.

Referring now to FIG. 4, there is shown a further embodiment of the preferred embodiment as has herein been described. Container elements 12' include substantially planar sections 18' and terminate in the radial direction in rim elements 28'. The main differences shown in this embodiment is that rim elements 28' generally are contoured in a truncated rhomboid geometrical contour and include a substantially rectangular lug member 38' joined in one piece formation to upper cooperating element or section 30'. Lower cooperating element or section 32' includes substantially rectangular contoured recess 40' adapted for insert of a cooperating lug member 38'.

Each of lug members 38' include upper apertures 34' which are adapted for alignable mounting with lower apertures 36' as is clearly seen in FIG. 4.

The main differences between the embodiment shown in FIG. 4 and that provided in FIGS. 1 and 2 is that rim element 28' surfaces are generally linear in contour and are adaptable to a stamping process as opposed to a molding process which would permit arcuate surfaces to be easily attainable. Additionally, the tapered internal surfaces 66 and 68 may provide for some increased food containment volume.

In this embodiment, it is preferred that the overall contour of container elements 12' be circular in order to easily provide slidable rotational displacement between interfacing rim elements 28'. This concept and geometrical formation would allow the varying of the through opening sizes when apertures 34' and 36' are in cooperating alignment.

Referring now to FIG. 5 there is shown a still further embodiment of the subject inventive concept wherein rim element 28'' is generally rectangular in contour. Additionally, lug or bead member 38'' is similarly rectangular in contour and is adapted for insert within a rectangular contoured recess 40''. As was the cases in the previously disclosed embodiments, upper and lower apertures 34'' and 36'' are provided respectively through upper cooperating element or section 30'' and lower cooperating element or section 32''. Substantially planar section 18' is joined at a radial peripheral edge to rim element 28'' in one piece formation to provide adaptability in either a stamping process or a molding type process.

Referring now to FIG. 6, there is shown a still further embodiment of the overall inventive concept. In this embodiment, rim elements 28''' are generally rectangular in contour, but include tapered outer walls 70 leading to bead elements 38'''. Tapered walls 70 are interfacingly mated with tapered internal walls 72 of recesses 40''' to provide an increased securement of one container 12''' with a next succeeding and interfacingly mounted container 12'''. As was the case in previous embodiments herein shown and described, upper apertures 34''' are alignable with lower apertures 36''' to provide the necessary vapor venting process. Planar section 18''' is joined generally in one piece formation to rim elements 28''' in order to facilitate the molding or stamping process associated with the manufacture of container elements 12'''.

In overall concept, container elements 12 and respective embodiment elements are formed of a material having a low thermal conductivity for maintaining thermal insulation of any heated food contained within container elements 12. In particular, container elements 12 may be formed in one piece formation and may be stamped or molded. Additionally, container elements 12 and respective elements may be formed of a styrofoam material or cardboard material well-known in the art. Overall dimensions of container elements 12 shown in FIG. 1 may have an overall diameter determined by user application. Successful applications have been had in forming container elements 12 with a diameter as low as six inches and a maximum diameter of twenty inches. However, it is to be understood that the particular size and dimensioning of container elements 12 is not important to the inventive concept as is herein shown and described.

In general, system 10 as has hereinbefore been shown, provides for a one-piece symmetrical container 12 which may be used for a multiplicity of purposes. Container 12 may be used as a tray 16 for consuming food or other edible matter in a commercial establishment, or may be formed in a simple manner into box-like structure 14 for removal of the contents to a remote consuming point. Symmetry of overall design allows ease or optimization of manufacturing in that previous containers are generally formed in two piece units whereas a simple one piece unit is herein provided to lower manufacturing costs. Additionally, disposability of container elements 12 allows labor saving concepts to be used by commercial establishments in that food products do not have to be removed and container elements 12 washed or sterilized. Subsequent to use, container elements 12 are merely disposed of along with other waste materials of the commercial establishment. Further, by providing resilient materials such as styrofoam and maintaining lug members 38 substantially the same overall contour, but slightly larger than recesses 40, there is a locking effect when box-like structures 14 are provided. In this manner, the user does not have to maintain one container element 12 in compressive contact with a second container element 12 in order to maintain a rigid box-like structure.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A disposable food tray and container system, comprising:

at least a pair of container elements, each of said container elements having a central substantially planar section and a rim element, each of said rim elements extending around said planar section in a closed contour, each of said rim elements having a pair of upper and lower cooperating elements for nesting interface of one of said upper cooperating elements of one of said container elements with said lower cooperating element of a next one of said container elements, each of said upper and lower cooperating elements having at least one aperture formed therethrough, said apertures being alignable for permitting exit of gaseous products when said upper and lower cooperating elements of said pair of container elements are in nesting interface.

2. The disposable food tray and container system as recited in claim 1 where each of said container elements are circular in contour when taken with respect to a cross-sectional plane normal to a vertical direction.

3. The disposable food tray and container system as recited in claim 2 where said container elements are in rotatable slidable contact each with respect to the other when said pair of container elements are in said nesting interface relationship.

4. The disposable food tray and container system as recited in claim 3 where each of said apertures extend throughout a predetermined segment of said circular contour for varying the size of a through opening when said apertures are aligned.

5. The disposable food tray and container system as recited in claim 4 where said upper cooperating element includes a lug member having at least one of aid apertures extending therethrough, said lower cooperating element having a recess formed therein for insert of an interfacing lug member of a next successively mounted container element.

6. The disposable food tray and container system as recited in claim 5 where said lug member is joined in one piece formation to said upper cooperating element, said lug member being arcuate in contour, said recess formed through said lower cooperating element being similar in contour when taken with respect to said lug member and being intercepted by said apertures.

7. The disposable food tray and container system as recited in claim 5 where said lug member and said recess are rectangular in cross-sectional contour.

8. The disposable food tray and container system as recited in claim 5 where said lug member and said recess include a first portion being rectangular in cross-sectional contour and a second portion having tapered wall segments for cooperating interface between a lug member and a recess formed within a next succeeding container element.

9. The disposable food tray and container system as recited in claim 5 where said upper cooperating element and lower cooperating element are displaced radially each from the other, each of said cooperating elements being joined to said planar section in one piece formation.

10. The disposable food tray and container system as recited in claim 9 where said upper and lower cooperating elements are radially displaced each from the other by a distance such that a lower cooperating element outer surface slidingly interfaces with an upper cooperating inner surface.

11. The disposable food tray and container system as recited in claim 1 where said container element planar section and rim element are formed in one-piece formation.

12. The disposable food tray and container system as recited in claim 11 where each of said container elements are molded in one-piece formation.

13. The disposable food tray and container system as recited in claim 1 where said lower cooperating element extends below a lower surface of said substantially planar section for maintaining said planar section remote from a base surface contiguous to said lower cooperating element.

14. The disposable food tray and container system as recited in claim 1 where said container elements are formed of a material having a low thermal conductivity for maintaining thermal insulation of food contained within said container elements.

15. The disposable food tray and container system as recited in claim 14 where each of said container elements is formed of a styrofoam material.

16. The disposable food tray and container system as recited in claim 14 where each of said container elements is formed of a cardboard material.

* * * * *